US006015616A

United States Patent [19]

Simons et al.

[11] Patent Number: 6,015,616

[45] **Date of Patent: *Jan. 18, 2000**

[54] DRAWN POLYESTER YARN HAVING A HIGH TENACITY, A HIGH MODULUS AND A LOW SHRINKAGE

[75] Inventors: F. Holmes Simons; Ron L. Griffith, both of Charlotte, N.C.

[73] Assignee: Arteva North America S.A.R.L., Zurich, Switzerland

[ * ] Notice: This patent is subject to a terminal disclaimer.

[21] Appl. No.: 08/719,135

[22] Filed: Feb. 20, 1996

Related U.S. Application Data

[63] Continuation of application No. 08/378,158, Jan. 25, 1995, abandoned, which is a continuation of application No. 08/072,652, Jun. 4, 1993, abandoned, which is a continuation of application No. 07/522,445, May 11, 1990, abandoned.

[51] Int. Cl.[7] ..... D02G 3/00

[52] U.S. Cl. ..... 428/364; 428/392

[58] Field of Search ..... 428/364, 392, 428/395, 373; 528/309

[56] References Cited

U.S. PATENT DOCUMENTS

| | | | |
|---|---|---|---|
| 3,616,832 | 11/1971 | Shima et al. | 152/361 |
| 3,651,198 | 3/1972 | Mitsuishi et al. | 264/235 |
| 3,832,436 | 8/1974 | Harris et al. | 214/210 |
| 3,929,180 | 12/1975 | Kawase et al. | 152/359 |
| 5,238,740 | 8/1993 | Simons et al. | 428/364 |

FOREIGN PATENT DOCUMENTS

| | | | |
|---|---|---|---|
| 1 325 107 | 8/1973 | United Kingdom | D01F 7/04 |
| 1 343 628 | 1/1974 | United Kingdom | D01F 7/04 |
| 1 445 464 | 8/1976 | United Kingdom | D01F 6/62 |

*Primary Examiner*—Newton Edwards
*Attorney, Agent, or Firm*—Gregory N. Clements

[57] ABSTRACT

In the instant invention, drawn yarns, with the following properties, are obtained: tenacity of at least 8.5 gpd; initial modulus of at least 150 gpd/100%; and shrinkage of less than 6%. Alternatively, the yarn may be characterized as: tenacity of greater than 10 gpd; initial modulus of greater than 120 gpd/100%; and shrinkage of less than 6%. These yarns are made by a process directed mainly toward affecting the yarn properties as they are spun.

6 Claims, 2 Drawing Sheets

DRAWN POLYESTER YARN HAVING A HIGH TENACITY, A HIGH MODULUS AND A LOW SHRINKAGE

RELATED APPLICATION

This is a continuation of application Ser. No. 08/378,158 filed Jan. 25, 1995, now abandoned, which is a continuation of application Ser. No. 08/072,652 filed Jun. 4, 1993, now abandoned, which is a continuation of Ser. No. 07/522,445 filed May 11, 1990, now abandoned.

FIELD OF THE INVENTION

The instant invention is directed to high strength, low shrinkage polyester yarns.

BACKGROUND OF THE INVENTION

Since fiber-forming, spinnable, synthetic polymers were introduced, fiber manufacturers have looked for ways to increase the strength and stability properties of the fibers made from those polymers. The additional strength and stability properties of the fibers are needed so that applications beyond textile uses could be opened for their products. Such non-textile uses (also known as "industrial uses") include: tire cord; sewing thread; sail cloth; cloth, webs or mats used for road bed construction or other geo-textile applications; industrial belts; composite materials; architectural fabrics; reinforcement in hoses; laminated fabrics; ropes; and the like.

Originally, rayon was used in some of these industrial uses. Thereafter, nylon supplanted rayon as the material of choice. In the 1970's, conventional polyesters, such as polyethylene terephthalate, were introduced into competition against nylon. In about 1985, higher performance polyester, i.e. higher strength and greater stability, were introduced.

A brief review of the patent prior art, summarized below, indicates that three general areas have been investigated as possible ways of enhancing the strength and stability properties of these synthetic fibers. Those general areas include: processes directed to drawing; processes directed to the polymer; and processes directed to the spinning. Hereinafter, the term "drawing" shall refer to the heating and stretching performed on an as-spun yarn. The term "treatment to the polymer" shall refer to those things done to the polymer prior to spinning. The term "spinning" shall refer to processes for forming filaments from polymer, but excluding drawing.

The processes directed to drawing are as follows:

In U.S. Pat. No. 3,090,997, multistage drawing of polyamides, for use as tire cords, is disclosed. The fibers (nylon) are melt-spun in a convention fashion. Thereafter, spun fibers are drawn in a three-stage process (drawn, then heated, then drawn again) to obtain a drawn nylon having the following properties: tenacity ranging from 10.4 to 11.1 grams per denier (gpd); elongation ranging from 12.9 to 17.1%; and initial modulus of 48 to 71 gpd/100%.

In U.S. Pat. No. 3,303,169, there is disclosed a single-stage drawing process for polyamides that yields high modulus, high tenacity, and low shrinkage polyamide yarns. The spun polyamide is drawn and heated to at least 115° C. to obtain a yarn having: tenacity in the range of 5 to 8.7 gpd; elongation ranging from 16.2 to 30.3%; initial modulus of 28 to 59 gpd/100%; and shrinkage ranging from 3.5 to 15%.

In U.S. Pat. No. 3,966,867, a two-stage drawing process for polyethylene terephthalate having a relative viscosity of 1.5 to 1.7 is disclosed. In the first stage, the fibers are subjected to a temperature between 70 and 100° C. and a draw ratio of 3.8 to 4.2. In the second stage, the fibers are subjected to a temperature between 210 and 250° C. and a draw ratio, in the aggregate of the first draw ratio and second draw ration, in the range of 5.6 to 6.1. The drawn yarn obtained has the following properties: tenacity, 7.5 and 9.5 gpd; elongation, approximately 2 to 5% at a load of 5 gpd; elongation at break, 9 to 15%; and shrinkage, 1 to 4%.

In U.S. Pat. No. 4,003,974, polyethylene terephthalate spun yarn, having an HRV of 24 to 28, is heated to 75 to 250° C. while being drawn, is then passed over a heated draw roll, and finally relaxed. The drawn yarn has the following properties: tenacity, 7.5 to 9 gpd; shrinkage, about 4%; elongation at break, 12 to 20%; and load bearing capacity of 3 to 5 gpd at 7% elongation.

Those processes directed to enhancing yarn properties by treatment to the polymer are as follows:

In U.S. Pat. Nos. 4,690,866 and 4,867,963, the intrinsic viscosity (I.V.) of the polyethylene terephthalate is greater than 0.90. In U.S. Pat. No. 4,690,868, the as-spun (undrawn) fiber properties are as follows: elongation at break, 52 to 193%; birefringence, 0.0626 to 0.136; and degree of crystallinity, 19.3 to 36.8%. The drawn fiber properties are as follows: tenacity, 5.9 to 8.3 gpd; elongation, 10.1 to 24.4%; and dry shrinkage (at 210° C.), 0.5 to 10.3%. In U.S. Pat. No. 4,867,936, the drawn fiber properties are as follows: tenacity, about 8.5 gpd; elongation at break, about 9.9%; and shrinkage (at 177° C.), about 5.7%.

Those processes directed to spinning are as follows:

In U.S. Pat. No. 3,053,611, polyethylene terephthalate after leaving the spinneret is heated to 220° C. in a spinning shaft two meters long. Thereafter, cold water is sprayed onto the fibers in a second shaft. The fibers are taken up at a speed of 1,600 meters per minute (mpm) and are subsequently drawn to obtain a tenacity of 3.5 gpd.

In U.S. Pat. No. 3,291,880, a polyamide is spun from a spinneret and then cooled to about 15° C., then the fiber is sprayed with live steam. The as-spun fiber has a low orientation and a low birefringence.

In U.S. Pat. No. 3,361,859, a synthetic organic polymer is spun into a fiber. As the fibers exit the spinneret, they are subjected to "controlled retarded cooling". This cooling is conducted over the first seven inches from the spinneret. At the top (i.e. adjacent the spinneret), the temperature is 300° C. and at the bottom (i.e. approximately 7 inches from the spinneret), the minimum temperature is 132° C. The as-spun yarn has a low birefringence (11 to $35\times10^{-3}$) and drawn yarn properties are as follows: tenacity, 6.9 to 9.4 gpd; initial modulus, 107 to 140 gpd/100%; and elongation at break, 7.7 to 9.9%.

In U.S. Pat. Nos. 3,936,253 and 3,969,462, there is disclosed the use of a heated shroud (ranging in length from one-half foot to two feet) with temperatures ranging from about 115 to 460° C. In the former, the temperature is greater at the top of the shroud than at the bottom. The drawn yarn properties of the former are as follows: tenacity, 9.25 gpd; elongation, about 13.5%; and shrinkage, about 9.5%. In the latter, the temperature is constant within the shroud and the drawn yarn properties are as follows: tenacity, 8 to 11 gpd; and elongation at break, 12.5 to 13.2%.

In U.S. Pat. No. 3,946,100, fibers are spun from a spinneret and solidified at a temperature below 80° C. The solidified fibers are then reheated to a temperature between the polymer's glass transition temperature (Tg) and its melting temperature. This heated fiber is withdrawn from the heating zone at a rate of between 1,000 to 6,000 meters per minute. Spun yarn properties are as follows: tenacity, 3.7 to 4.0 gpd; initial modulus, 70 to 76 gpd/100%, and birefringence, 0.1188 to 0.1240.

In U.S. Pat. No. 4,491,657, polyester multifilament yarn is melt-spun at high speed and solidified. Solidification occurs in a zone comprising, in series, a heating zone and a cooling zone. The heating zone is a barrel shaped heater (temperature ranging from the polymer's melting temperature to 400° C.) ranging in length from 0.2 to 1.0 meters. The cooling zone is cooled by air at 10° C. to 40° C. Drawn yarn made by this process has the following properties: initial modulus, 90–130 gpd; and shrinkage (at 150° C.) less than 8.7%.

In U.S. Pat. No. 4,702,871, fiber is spun into a chamber having a subatmospheric pressure. Spun yarn properties are as follows: strength, 3.7 to 4.4 gpd; birefringence, 104.4 to 125.8 ($\times 10^{-3}$); and dry heat contraction, 4.2 to 5.9% at 160° C. for 15 minutes.

In U.S. Pat. No. 4,869,958, the fiber is spun in the absence of heat and then taken up. At this point, the fiber has a low degree of crystallinity, but it is highly oriented. Thereafter, the fiber is heat treated. The drawn fiber properties are as follows: tenacity, 4.9 to 5.2 gpd; initial modulus, 92.5 to 96.6 gpd/100%; and elongation, 28.5 to 32.5%.

The foregoing review of patents indicates that while some of the fibers produced by these various processes have high strength or low shrinkage properties, none of the foregoing patents teach of a yarn or a process for producing a drawn yarn having the combination of high tenacity, high initial modulus, and low shrinkage.

The patents which come closest to teaching such a drawn yarn are U.S. Pat. Nos. 4,101,525 and 4,195,052, related patents that are assigned to the assignee of the instant invention. In these patents, the polyester filaments (the polymer having an intrinsic viscosity of 0.5 to 2.0 deciliters per gram) are melt spun from a spinneret. Molten filaments are passed through a solidification zone where they are uniformly quenched and transformed into solid fibers. The solid fibers are drawn from the solidification zone under a substantial stress (0.015 to 0.15 gpd). These as-spun solid fibers exhibit a relatively high birefringence (about 9 to $70\times10^{-3}$). The as-spun fibers are then drawn and subsequently heat treated. The drawn filament properties are as follows: tenacity, 7.5 to 10 gpd; initial modulus, 110 to 150 gpd/100% and shrinkage, less than 8.5% in air at 175° C.

SUMMARY OF THE INVENTION

In the instant invention, drawn yarns, with the following properties, are obtained: tenacity of at least 8.5 gpd; initial modulus of at least 150 gpd/100%; and shrinkage of less than 6%. Alternatively, the yarn may be characterized as: tenacity of greater than 10 gpd; initial modulus of greater than 120 gpd/100%; and shrinkage of less than 6%. These yarns are made by a process directed mainly toward affecting the yarn properties as they are spun.

DESCRIPTION OF THE DRAWINGS

For the purpose of illustrating the invention, there is shown in the drawing a schematic of the process which is presently preferred; it being understood, however, that this invention is not limited to the precise arrangement and instrumentalities shown.

DETAILED DESCRIPTION OF THE INVENTION

The instant invention is directed to high tenacity, high initial modulus, and low shrinkage drawn yarns and the process by which such yarns are made. The term "yarn" or "filament" or "fiber" shall refer to any fiber made from a melt spinnable synthetic organic polymer. Such polymers may include, but are not limited to, polyesters and polyamides. The invention, however, has particular relevance to polyesters such as, for example, polyethylene terephthalate (PET), blends of PET and polybutylene terephthalate (PBT), and PET cross-linked with multifunctional monomers (e.g. pentaerithritol). Any of the foregoing polymers may include conventional additives. The yarn I.V. (for PET based polymer) may be between 0.60 and 0.87. The instant invention, however, is not dependent upon the intrinsic viscosity (I.V.) of the polymer.

Figure 1:
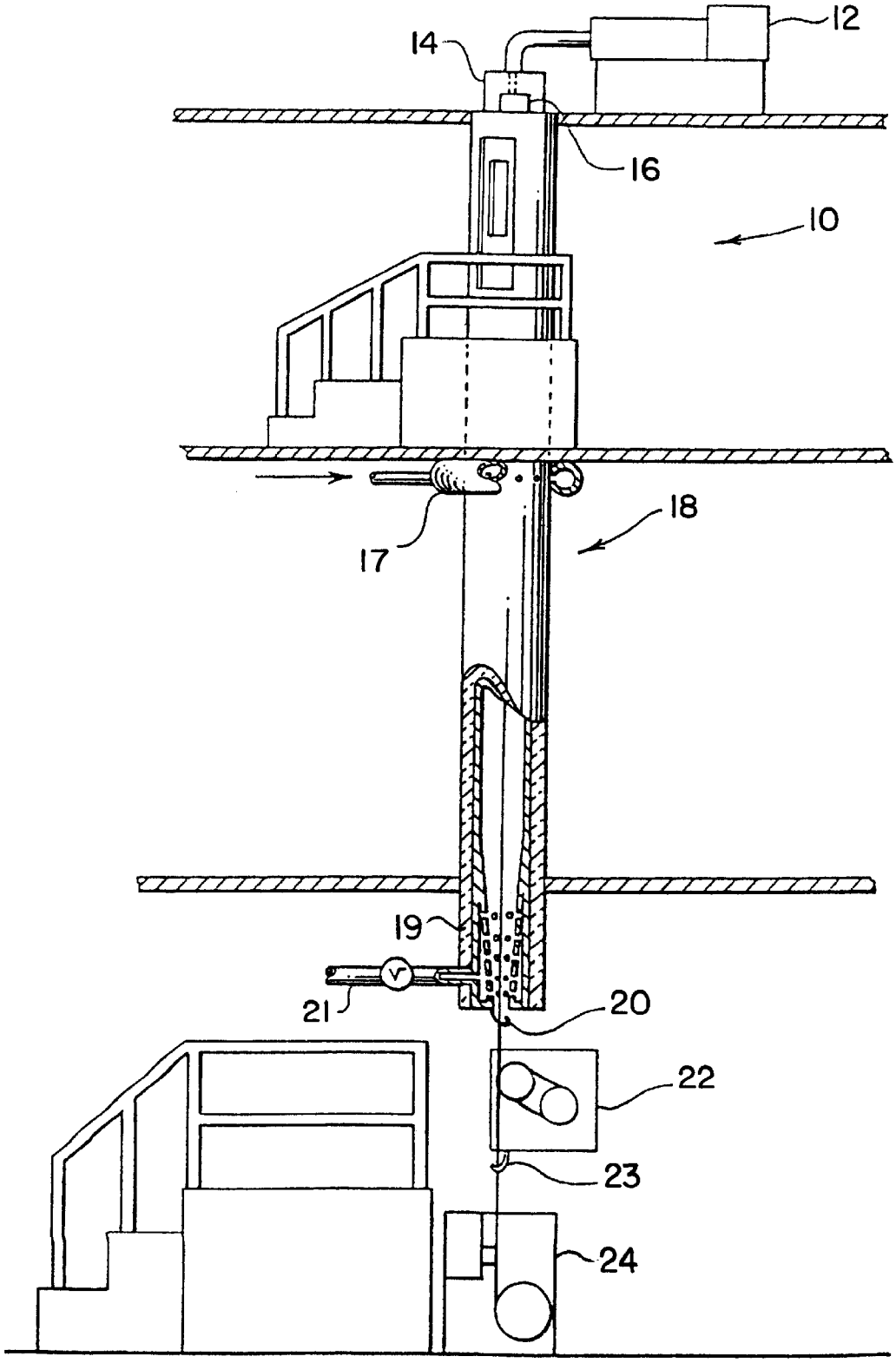
FIG. 1 is a schematic elevational view of the spinning process.

Referring to FIG. 1, a spinning apparatus 10 is illustrated. A conventional extruder 12 for melting polymer chip is in fluid communication with a conventional spinning beam 14. Within spinning beam 14, there is a conventional spinning pack 16. Pack 16 may be of an annular design and it filters the polymer by passing the polymer through a bed of finely divided particles, as is well known in the art. Included as part of the pack 16 is a conventional spinneret (not shown). Flow rates of polymers through the pack may range from about 10 to 55 pounds per hour. The upper limit of 55 pounds is defined only by the physical dimensions of the pack 16 and greater flow rates may be obtained by the use of larger packs. The spun denier per filament (dpf) ranges from 3 to 20; it being found that the optimum properties and mechanical qualities for the yarn appear between 5 and 13 dpf.

Optionally, the fiber, as it leaves the spinneret, may be quenched with a hot inert gas (e.g. air). See U.S. Pat. No. 4,378,325 which is incorporated herein by reference. Typically, the gas is about 230° C. and is provided at about six standard cubic feet per minute (scfm). If the air is too hot, i.e. over 260° C., the spun yarn properties are significantly deteriorated.

Immediately below and snugly (i.e. airtight) mounted to spinning beam 14 is an elongated column 18. The column comprises an insulated tube having a length of about 5 meters or greater. Column length will be discussed in greater detail below. The tube's internal diameter is sufficiently large (e.g. twelve inches) so that all filaments from the spinneret may pass the length of the tube without obstruction. The column is equipped with a plurality of conventional band heaters so that the temperature within the tube can be controlled along its length. Column temperatures will be discussed in greater detail below. The column is, preferably, subdivided into a number of discrete temperature zones for the purpose of better temperature control. A total of 4 to 7 zones have been used. Optionally, the column 18 may include an air sprayer 17 that is used to control temperature in the column. Sparger 17 is designed to evenly distribute an inert gas around the circumference of the column.

Inside the bottom-most end of the column 18 is a perforated, truncated cone 19, i.e. a means for reducing air turbulence. The cone 19, which is preferably three feet in length and having a diameter co-extensive with the tube diameter at its uppermost end and a diameter of about one half that at the bottom end, is used to exhaust air from the bottom-most end of the tube so that movement in the thread line, due to air turbulence, is substantially reduced or eliminated completely.

Below the bottom-most end of the column, the thread line is converged. This convergence may be accomplished by a finish applicator 20. This is the first contact the yarn encounters after leaving the spinneret.

The length of the column, non-convergence of the individual filaments, and the temperature profile within the column are of particular importance to the instant invention. With regard to the temperature profile, it is chosen so that the fibers are maintained at a temperature above their Tg over a significant length of the column (e.g. at least 3 meters). This temperature could be maintained over the entire length of the column, but the wound filaments would be unstable. Therefore, for practical reasons, the temperature within the column is reduced to below the Tg, so that the filaments will no further changes in crystal structure before being wound up. Preferably, the temperature profile is chosen to reflect the temperature profile that would be established within the tube if no external heat was applied. However, the "no external heat" situation is impractical because of numerous variables that influence the column temperature. So, the temperature profile is controlled, preferably in a linear fashion, to eliminate temperature as a variable in the process.

The air temperature within the column is controlled by the use of the band heaters. Preferably, the column is divided into a plurality of sections and the air temperature in each section is controlled to a predetermined value. Thus, the temperature within the column can be varied over the length of the column. The temperature within the column may range from as high as the polymer spinning temperature to at or below the glass transition (Tg) temperature of the polymer (Tg for polyester is about 80° C.). The polymer spinning temperature occurs around the spinneret, i.e. as the molten polymer exits the spinneret. However, air temperatures within the column are preferably controlled from about 155° C. to about 50° C. At wind-up speeds less than 14,000 feet per minute, the first section adjacent the spinneret is preferably controlled to a temperature of about 155° C. and the section furthest from the spinneret is controlled to about 50° C.

However, a linear temperature profile is not the only temperature pattern that will yield the beneficial results disclosed herein. At take-up (or wind-up) speeds greater than 14,000 fpm (4,300 mpm), the temperature profile (when the column is divided into four discrete zones) is as follows: (starting from the spinneret down) the first zone—about 105° C. to about 110° C.; the second zone—about 110° C. to about 115° C.; the third zone—about 125° C. to about 130° C.; and the fourth zone—115° C. to about 120° C.

With regard to column length, a minimum column length of five meters (with column temperature over the polymer's Tg for at least 3 meters) with filament convergence thereafter appears to be necessary for the instant invention. Column lengths between five and nine meters are suitable for the invention. The upper limit of nine meters is a practical limit and may be increased, room permitting. To optimize the tenacity properties, a column length of about seven meters is preferred.

The fibers are converged after exiting the column 18. This convergence may be accomplished by use of a finish applicator.

Following the first application of the finish (i.e. at finish applicator 20), the yarn is taken around a pair of godet rolls 22. Thereafter, a second application of finish may be made (i.e. at finish applicator 23). The first finish application may be made to reduce static electricity built up on the fibers. But this finish is sometimes thrown off as the fibers pass over the godet rolls. Thus, the finish may be reapplied after the godet rolls.

The fibers are then passed onto a conventional tension control winder 24. The wind-up speed is typically greater than 3,000 mpm (9,800 fpm) with a maximum speed of 5,800 mpm (19,000 fpm). An optimum range exists of about 10,500 to 13,500 fpm (about 3,200–4,100 mpm). The most preferred range exists between about 3200 and 3800 mpm (10,500 and 12,500 fpm). At speeds below 9,800 fpm (3,000 mpm), the yarn uniformity properties deteriorate.

The as spun polyester yarn produced by the foregoing process be generally characterized as having relatively small crystals and relatively high orientation. It is believed that these qualities of the as spun yarn enable the attainment of the unique drawn yarn properties discussed below.

To quantify the general characterization of the as spun polyester yarn, the small crystals are defined in terms of crystal size (measured in Å) and orientation is defined in one of the following terms: optical birefringence; amorphous birefringence; or crystal birefringence. Additionally, the spun polyester yarn is characterized in term of crystal size and long period spacing (the distance between crystals). In board terms, the as spun polyester yarn may be characterized as having a crystal size less than 55 Å and either an optical birefringence greater than 0.090 or an amorphous birefringence greater than 0.060 or a long period spacing of less than 300 Å. More preferred, the as spun polyester yarn may be characterized as having a crystal size ranging from about 20 to about 55 Å and either an optical birefringence ranging from about 0.090 to about 0.140 or an amorphous birefringence ranging from about 0.060 to about 0.100 or a long period spacing ranging from about 100 to about 250 Å. Most preferred, the as spun polyester yarn may be characterized as having a crystal size ranging from about 43 to about 54 Å and either an optical birefringence ranging from about 0.100 to about 0.130 or an amorphous birefringence ranging from about 0.060 to about 0.085 or a long period spacing ranging from about 140 to about 200 Å.

As will be apparent to those of ordinary skill in the art, the crystal size of the spun yarn is about ⅓ that of conventional yarns in the optimum wind-up speed range. The crystal size increases with speed, but it still remains low. The spun amorphous orientation is very high, about twice normal. This spun yarn has such a high orientation and low shrinkage, that it could be used without any drawing.

In addition, the spun polyester yarn has the following properties: a crystal content (i.e. crystallinity level as determined by density) of 10 to 43%; a spun tenacity of about 1.7 to 5.0 gpd; a spun modulus in the range of 10 to 140 gpd/100; a hot air shrinkage of about 5 to 45%; and an elongation of 50–160%.

Figure 2:
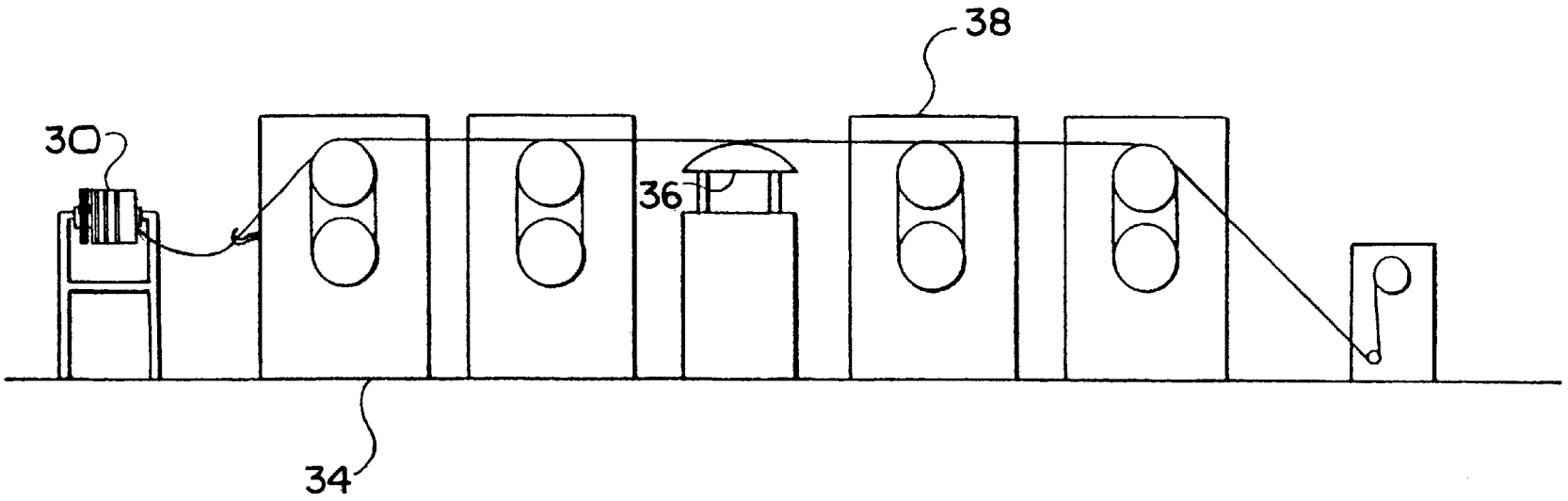
FIG. 2 is a schematic elevational view of the drawing process.

Thereafter, the spun yarn is drawn. Refer to FIG. 2. Either a one or two stage drawing operation may be used. However, it has been determined that a second stage offers little-to-no additional benefit. It is possibly that the spinning operation may be coupled directly to a drawing operation (i.e., spin/draw process).

The as-spun yarn may be fed from a creel 30 onto a feed roll 34 that may be heated from ambient temperatures up to about 150° C. Thereafter, the fiber is fed onto a draw roll 38 which may be heated from ambient temperatures to approximately 255° C. If heated rolls are not available, a hot plate 36, which may be heated from 180°–245°, may be used. The hot plate 36 (having a six inch curved contact surface) is placed in the draw zone, i.e., between feed roll 34 and draw roll 38. The draw speed ranges from 75 to 300 meters per minute. The typical draw ratio is about 1.65 (for spun yarn made at about 3,800 meters per minute). The optimum feed roll temperature, giving the highest tensile strength, was found to be about 90° C. The optimum draw roll temperature is about 245° C. If the hot plate is used, the optimum temperature is between about 240°–245° C. The draw roll temperature gives some control over hot air shrinkage. In general, low shrinkages are desirable as they give rise to the best treated cord stability ratings. However, at least one end use, sail cloth, requires higher drawn yarn shrinkages and these can be controlled with lower draw roll temperatures.

Based on the foregoing, the drawn fiber properties may be controlled as follows: Tenacity may range from 4.0 to 10.8 grams per denier. The elongation may range from 7% to approximately 80%. The initial secant modulus may range from 60 to 170 gpd/100%. The hot air shrinkage (at 177° C.) is 6% to 15%. The denier of the fiber bundle may range from 125 to 1100 (the latter number may be obtained by plying tows together) and the denier per filament ranges from 1.5 to 6 dpf. Such a yarn could be used as the fibrous reinforcement of a rubber tire.

Polyester (i.e., PET) drawn yarns, made according to the process described above, can obtain an initial secant modulus greater than 150 grams per denier/100. Moreover, those yarns may also have a shrinkage of less than 8%, or those yarns may have a tenacity of greater than 7.5 grams per denier.

Another preferred embodiment of the drawn polyester yarn may be characterized as follows: a tenacity of at least 8.5 grams per denier; an initial modulus of at least 150 grams per denier/100%, and a shrinkage of less than 6%. Another preferred embodiment of the drawn polyester yarn may be characterized as follows: a tenacity of at least 10 grams per denier; an initial modulus of at least 120 grams per denier/100%; and a shrinkage of less than 6%. Yet another preferred embodiment of the drawn polyester yarn may be characterized as follows: a tenacity ranging from about 9 to about 9.5 grams per denier; an initial modulus ranging from about 150 to about 158 grams per denier/100%; and a shrinkage less than 7.5%.

Any drawn yarn, made according to the above described process, may be utilized in the following end uses: tire cord, sewing thread; sail cloth; cloth, webs or mats used in road bed construction or other geo-textile applications; industrial belts; composite materials; architectural fabrics; reinforcement in hoses; laminated fabrics; ropes; etc.

The following critical tests, which are used in the foregoing discussion of the invention and the subsequent examples, were performed as follows:

Tenacity refers to the "breaking tenacity" as defined in ASTM D-2256-80.

Initial modulus (or "initial secant modulus") is defined p4er ASTM D-2256-80, Section 10.3, except that the line representing the initial straight line portions of the stress-strain curve is specified as a secant line passing through the 0.5% and 1.0% elongation points on the stress-strain curve.

All other tensile properties are as defined in ASTM D-2256-80.

Shrinkage (HAS) is defined as the linear shrinkage in a hot air environment maintained at 177±1° C. per ASTM D-885-85.

Density, crystal size, long periods spacing, crystal birefringence, and amorphous birefringence are the same as set forth in U.S. Pat. No. 4,134,882 which is incorporated herein by reference. Specifically, each of the foregoing may be found in U.S. Pat. No. 4,134,882 at or about: density—column 8, line 60; crystal size—column 9, line 6; long period spacing—column 7, line 62; crystal birefringence—column 11, line 12; and amorphous birefringence—column 11, line 27.

Birefringence (optical birefringence or Δn) is as set forth in U.S. Pat. No. 4,101,525 at column 5, lines 4–46. U.S. Pat. No. 4,101,525 is incorporated herein by reference. "Bi CV" is the coefficient of variation of optical birefringence between filaments calculated from 10 measured filaments.

Other tests referred to herein are performed by conventional methods.

Reference should now be made to the Example which will more fully illustrate the instant invention.

EXAMPLE I

In the following set of experimental runs, a conventional polyester polymer (PET, IV-0.63) was spun. The spinning speeds were increased from 12,500 fpm to 19,000 fpm. The column length was 6.4 meters and divided into four temperature control zones. The temperature was controlled by measuring the air temperature close to the wall at the center of each zone. The polymer was extruded at a rate of 22.9 pounds per hour through a spinning beam at 285° C. and a 40 hole spinneret (hole size 0.009 inches by 0.013 inches). The fibers were not quenched. The spun fibers were not drawn, but they were heat set. The results are set forth in TABLE I.

TABLE I

| | No. 1 | No. 2 | No. 3 | No. 4 | No. 5 | No. 6 | No. 7 | No. 8B |
|---|---|---|---|---|---|---|---|---|
| Spin Speed, fpm | 12,500 | 13,500 | 14,500 | 15,500 | 16,500 | 17,500 | 18,500 | 19,000 |
| Col Temp. | | | | | | | | |
| Top, ° C. | 110 | 108 | 105 | 104 | 105 | 105 | 106 | 105 |
| 2nd, ° C. | 105 | 104 | 104 | 107 | 109 | 110 | 106 | 110 |
| 3rd, ° C. | 131 | 130 | 129 | 132 | 132 | 132 | 130 | 133 |
| Bottom, ° C. | 109 | 107 | 105 | 111 | 111 | 111 | 109 | 119 |
| Denier | 340 | 310 | 290 | 270 | 255 | 240 | 225 | 220 |
| dpf | 8.5 | 7.8 | 7.2 | 6.8 | 6.4 | 6.0 | 5.6 | 5.5 |
| "True Stress" at Break gpd | 6.51 | 6.41 | 6.55 | 6.65 | 7.23 | 6.98 | 6.86 | 7.14 |
| Spun: | | | | | | | | |
| Denier | 340 | 316 | 289 | 270 | 254 | 240 | 228 | 222 |
| Tenacity, gpd | 3.93 | 3.89 | 4.10 | 4.18 | 4.55 | 4.52 | 4.57 | 4.71 |
| Elong, % | 65.7 | 64.8 | 59.8 | 59.2 | 59.0 | 54.5 | 50.0 | 51.6 |

TABLE I-continued

| | No. 1 | No. 2 | No. 3 | No. 4 | No. 5 | No. 6 | No. 7 | No. 8B |
|---|---|---|---|---|---|---|---|---|
| T $\sqrt{E}$ | 31.8 | 31.3 | 31.7 | 32.3 | 34.9 | 33.4 | 32.3 | 33.8 |
| I.M., gpd/100% | 54.0 | 56.4 | 52.1 | 59.2 | 65.4 | 60.1 | 66.6 | 76.2 |
| HAS, %-350° F. | 6.0 | 6.5 | 7.0 | 7.5 | 7.2 | 7.5 | 7.0 | 7.2 |
| Uster, % | .96 | 1.29 | 1.14 | 1.28 | 1.33 | 1.59 | 1.34 | 1.52 |
| Finish, % | .098 | .358 | .119 | .168 | .263 | .037 | .160 | .267 |
| IV | .623 | .630 | .629 | .631 | .630 | .629 | .626 | .627 |
| % Cryst. | 34.2 | 35.3 | 37.2 | 39.0 | 40.3 | 42.2 | 43.2 | 43.3 |
| $\Delta n \times 10^{-3}$ | 108 | 106 | 115 | 112 | 118 | 124 | 127 | 130 |
| BiCV % | 3.2 | 4.3 | 6.5 | 5.8 | 4.7 | 6.7 | 6.9 | 8.4 |
| Density, gms/cc | 1.3728 | 1.3742 | 1.3766 | 1.3788 | 1.3804 | 1.3827 | 1.3840 | 1.3841 |
| Yield Point Tenacity, gpd | 1.18 | 1.26 | 1.38 | 1.48 | 1.57 | 1.67 | 1.75 | 1.80 |
| Heat-Set: | | | | | | | | |
| Denier | 338 | 308 | 287 | 271 | 252 | 240 | 226 | 231 |
| Tenacity, gpd | 4.06 | 4.19 | 4.26 | 4.34 | 4.33 | 4.46 | 4.65 | 4.64 |
| Elong, % | 62.3 | 58.6 | 53.2 | 51.0 | 49.5 | 46.6 | 44.4 | 45.1 |
| T $\sqrt{E}$ | 32.0 | 32.1 | 31.1 | 31.0 | 30.5 | 30.5 | 31.0 | 31.2 |
| I.M., gpd/100% | 60.2 | 62.2 | 66.3 | 70.0 | 68.8 | 64.0 | 73.2 | 72.6 |
| HAS, %-350° F. | 2.0 | 2.2 | 2.8 | 2.8 | 3.0 | 3.2 | 3.0 | 2.5 |
| % Cryst. | 55.7 | 55.9 | 56.6 | 56.9 | 56.9 | 57.0 | 57.3 | 57.2 |
| $\Delta n \times 10^{-3}$ | 152 | 142 | 143 | 145 | 150 | 146 | 156 | 160 |
| BiCV % | 5.8 | 7.9 | 7.9 | 6.3 | 7.0 | 6.5 | 9.1 | 6.3 |
| Density, gms/cc | 1.3996 | 1.3999 | 1.4007 | 1.4011 | 1.4011 | 1.4013 | 1.4016 | 1.4015 |
| Yield Point Tenacity, gpd | 0.89 | 0.97 | 1.04 | 1.11 | 1.19 | 1.25 | 1.33 | 1.30 |

EXAMPLE II

In the following set of experimental runs, a conventional polyester (PET, IV-0.63) was spun. The column temperatures were varied as indicated (air temperature, center of zones). The column length was 6.4 meters. The polymer was extruded at a rate of 23.1 pounds per hour through a spinning beam at 300° C. and a 72 hole spinneret (hole size 0.009 inches by 0.012 inches). The fibers were not quenched. The spun fibers were subsequently drawn (as indicated). The results are set forth in TABLE II.

TABLE II

| | No. 1 | No. 4 | No. 5 | No. 2 | No. 3 | No. 6 | No. 7 |
|---|---|---|---|---|---|---|---|
| Spin Speed-fpm-1000's | 10.5 | 10.5 | 10.5 | 12.5 | 12.5 | 12.5 | 12.5 |
| Hot Quench-scfm/° C. | 6/230° | | | | | | |
| Air Bleed*-scfm/° C. | 30/35° | | | | | | |
| Col. Temp | | | | | | | |
| Top ° C. | 70 | 68 | 120 | 80 | 98 | 121 | 135 |
| 2nd ° C. | 83 | 101 | 99 | 81 | 88 | 101 | 107 |
| 3rd ° C. | 75 | 88 | 85 | 75 | 78 | 86 | 88 |
| Bottom ° C. | 62 | 72 | 79 | 64 | 65 | 80 | 81 |
| Spun: | | | | | | | |
| Denier | 370 | 367 | 369 | 344 | 342 | 342 | 342 |
| Tenacity-gpd | 2.87 | 3.68 | 3.77 | 3.50 | 3.72 | 3.86 | 3.75 |
| Elong-% | 122 | 81.8 | 83.2 | 82.6 | 79.6 | 70.9 | 69.0 |
| I.M.-gpd/100% | 63 | 93 | 93 | 86 | 86 | 73 | 7.5 |
| HAS-% 350° F. | 65.5 | 27.2 | 41.0 | 49.5 | 42.0 | 11.2 | 9.5 |
| Uster-% | 1.38 | 1.14 | 1.41 | .99 | 1.13 | 1.23 | 2.29 |
| Finish-% | 1.82 | .44 | .74 | .96 | .85 | .50 | .54 |
| IV | .63 | .64 | .64 | .64 | .64 | .64 | .64 |
| $\Delta n \times 10^{-3}$ | 78 | 115 | 113 | 105 | 111 | 107 | 106 |
| % Cryst. | 11.0 | 17.9 | 16.6 | 14.8 | 15.9 | 20.5 | 24.7 |
| Max Draw Ratio (D.R.) | 1.70 | 1.80 | 1.80 | 1.60 | 1.57 | 1.77 | 1.74 |
| Denier | 224 | 210 | 213 | 218 | 227 | 202 | 206 |
| Tenacity-gpd | 5.60 | 8.72 | 8.63 | 7.31 | 7.04 | 8.74 | 8.67 |
| Elong-% | 18.4 | 8.9 | 8.6 | 11.0 | 11.6 | 7.5 | 8.1 |
| I.M.-gpd/100% | 92 | 137 | 133 | 127 | 110 | 146 | 140 |
| HAS-% 350° F. | 6.2 | 10.0 | 9.8 | 9.2 | 7.8 | 10.0 | 10.0 |
| Max D.R. - .03 | 1.65 | 1.77 | 1.77 | 1.54 | 1.54 | 1.74 | 1.72 |
| Denier | 230 | 214 | 217 | 227 | 231 | 205 | 205 |
| Tenacity-gpd | 5.34 | 8.30 | 8.72 | 7.04 | 7.09 | 8.61 | 8.31 |
| Elong-% | 19.9 | 9.3 | 9.2 | 13.1 | 13.1 | 7.7 | 7.6 |
| I.M.-gpd/100% | 82 | 120 | 137 | 123 | 107 | 145 | 124 |
| HAS-% 350° F. | 6.0 | 9.8 | 10.0 | 9.0 | 7.8 | 10.2 | 10.0 |

*Air sparger, item 17, FIG. 1

In the above set of experimental runs (i.e. those set forth in TABLE II), Nos. 4, 5, 6 and 7 represent the instant invention.

EXAMPLE III

In the following sets of experimental runs, conventional polyester (PET, IV-0.63) was spun. The fibers were wound up at a rate of 10,500 fpm. The polymer was extruded at a rate of 19.5 pounds per hour through a 72 hole spinneret (hole size 0.009 inches by 0.012 inches) and a spinning beam at 300° C. The fibers were quenched with 6.5 scfm air at 232° C. The column was 6.4 meters long and divided into 4 sections having the following air temperature profile (in descending order): 135° C.; 111° C.; 92° C.; and 83° C. at the center of the zones. The spun yarn had the following properties: denier—334; tenacity—4.09 gpd; elongation 71.7%; initial modulus—55.0 gpd/100%; hot air shrinkage—11.8% at 350° F.; Uster 1.10; I.V.—0.647; FOY—0.35%; birefringence—$110\times10^{-3}$; and crystallinity—21.6%.

In TABLE IIIA, the effect of draw ratio on drawn yarn properties is illustrated.

TABLE IIIA

| Draw Ratio | 1.65 | 1.60 | 1.54 |
|---|---|---|---|
| Denier | 209 | 218 | 226 |
| Tenacity gpd | 8.15 | 7.53 | 7.12 |
| Elongation % | 8.4 | 8.9 | 10.4 |
| Initial Modulus gpd/100% | 123 | 115 | 115 |
| Hot Air Shrinkage % 350° F. | 12.0 | 12.4 | 12.0 |

In Table IIIB, the effect of the heating method during stretching is illustrated (the draw ratio was 1.65 and the yarn was not relaxed).

TABLE IIIB

| Denier | Tenacity gpd | Elongation % | Initial Modulus gpd/100% | Hot Air Shrinkage 350° F. % | Feed Roll Temp. ° C. | Hot Plate Temp. ° C. | Draw Roll Temp. ° C. |
|---|---|---|---|---|---|---|---|
| 334 | 4.09 | 71.7 | 55 | 11.8 | | (As Spun) | |
| 209 | 8.15 | 8.4 | 123 | 12.0 | Amb | 245 | Amb |
| 214 | 6.67 | 9.2 | 95 | 19.0 | 78 | Amb | Amb |
| 212 | 8.05 | 9.3 | 86 | 8.0 | 78 | 245 | Amb |
| 209 | 8.05 | 9.0 | 93 | 9.0 | 78 | Amb | 200 |
| 211 | 8.45 | 9.1 | 110 | 9.2 | 78 | 245 | 200 |
| 211 | 7.96 | 8.8 | 110 | 9.2 | 100 | 245 | 200 |
| 211 | 8.18 | 9.2 | 108 | 9.2 | 120 | 245 | 200 |

In Table IIIC, the effect of higher drawing temperatures and draw ratios is illustrated (the feed roll is at ambient temperature and the draw roll is at 240° C.).

TABLE IIIC

| Draw Ratio | 1.76 | 1.72 | 1.70 | 1.67 | 1.64 | 1.61 |
|---|---|---|---|---|---|---|
| Denier | 195 | 194 | 199 | 203 | 209 | 208 |
| Tenacity gpd | 9.50 | 9.22 | 8.89 | 8.73 | 7.76 | 6.71 |
| Elongation % | 6.1 | 6.1 | 6.3 | 6.7 | 6.6 | 7.5 |
| Hot Air Shrinkage %-350° F. | 6.8 | 7.0 | 6.8 | 6.5 | 6.8 | 6.5 |

EXAMPLE IV

In the following set of experimental runs, a conventional polyester (PET, IV-0.92) was spun. In runs Nos. 1–5, the fibers were spun in accordance with the methods set forth in U.S. Pat. Nos. 4,101,525 and 4,195,052. Nos. 6–9 were made as follows.

PET with a molecular weight characterized by an I.V. of 0.92 was dried to a moisture level of 0.001% or less. This polymer was melted and heated to a temperature of 295° C. in an extruder and subsequently forwarded to a spinning pack by a metering pump. This pack was of an annular design, and provided filtration of the polymer by passing it through a bed of finely divided metal particles. After filtration the polymer was extruded through an 80 hole spinneret. Each spinneret hole had a round cross section with a diameter of 0.457 mm and a capillary length of 0.610 mm.

An insulated heated tube 9 meters in length was mounted snugly below the pack and the multifilament spinning threadline passed through the entire length of this tube before being converged or coming into contact with any guide surfaces. The tube was divided down its length into seven zones for the purposes of temperature control. Individual controllers were used to set the air temperature at the center of each of these zones. Using a combination of process heat and the external heaters around the tube, individual controller settings were selected to arrive at a uniform air temperature profile down the vertical distance of this tube. In a typical situation the air temperature was 155° C. at the top zone of the tube and the temperature was reduced in an approximately uniform gradient to 50° C. at the bottom.

Approximately 10 cm below the tube the threadline was brought into contact with a finsh applicator which also served as the convergence guide and the first contact that the yarn encountered. At the exit of the tube the cross section of the un-converged yarn was very small due to the proximity of the finish guide. This permitted a very small aperture to be used, thus minimizing the amount of hot air lost from the tube.

Following the application of spin finish the yarn was taken to a pair of godet rolls and then to a tension controlled winder. Wind up speeds were typically in the range 3200–4100 mpm.

Drawing of this yarn was effected in a second step, in which the as spun yarn was passed over one set of pretension rolls to a heated feed roll maintained at a temperature set between 80 and 150° C. The yarn was then drawn between these rolls and a set of draw rolls maintained at a set point chosen in the range 180 to 255° C. A typical draw ratio for a spun yarn made at 3800 mpm would be 1.65, with samples spun at higher and lower speeds requiring lower or higher draw ratios, respectively.

The results are set forth in TABLE IV.

TABLE IV

| | | | Feed Roll Temperature ° C. | | | | | |
|---|---|---|---|---|---|---|---|---|
| | | | 25 | | | 90 | | |
| No. | Spinning Speed (fpm) | Spun Yarn Birefringence ×10−3 | Tenacity gpd | Initial Modulus gpd/100% | Drawn Yarn Shrinkage % 350° F. | Tenacity gpd | Initial Modulus gpd/100% | Drawn Yarn Shrinkage % 350° F. |
| 1 | 5000 | 21.9 | 7.94 | 115.00 | 7.30 | 5.96 | 78.00 | 5.30 |
| 2 | 6000 | 30.1 | 7.85 | 118.00 | 7.00 | 6.90 | 103.00 | 6.70 |
| 3 | 7000 | 45.2 | 8.36 | 120.00 | 7.00 | 7.21 | 108.00 | 6.50 |
| 4 | 8000 | 60.5 | 8.51 | 130.00 | 7.80 | 7.31 | 113.00 | 6.00 |
| 5 | 9000 | 78 | 8.56 | 122.00 | 6.80 | 7.67 | 110.00 | 6.00 |
| 6 | 10500 | 104 | 9.52 | 158.00 | 7.50 | 10.94 | 173.00 | 7.30 |
| 7 | 11500 | 115 | 9.03 | 150.00 | 6.80 | 9.52 | 152.00 | 7.00 |
| 8 | 12500 | 121 | 9.08 | 152.00 | 7.50 | 9.53 | 160.00 | 7.30 |
| 9 | 13500 | 119 | 9.32 | 154.00 | 6.00 | 9.58 | 161.00 | 6.70 |

EXAMPLE V

Polyester with a molecular weight characterized by an I.V. of 0.92 was dried to a moisture level of 0.001%. This polymer was melted and heated to a temperature of 295° C. in an extruder and the melt subsequently forwarded to a spinning pack by a metering pump. After filtration in a bed of finely divided metal particles, the polymer was extruded through an 80 hole spinneret. Each spinneret hole had a diameter of 0.457 mm and a capillary length of 0.610 mm. On extrusion the measured I.V. of this polymer was 0.84.

The extruded polymer was spun into heated cylindrical cavity 9 meters in length. An approximately linear temperature profile (gradient) was maintained over the length of this tube. At the center of the top zone, the air temperature was 155° C. and at the bottom of the tube this temperature was 50° C. The multi-filament yarn bundle was not converged until it came in contact with a finish guide just below the exit of the heated tube. From this point the yarn was advanced by a pair of godet rolls to a tension controlled winder. Under these conditions a series of four spun yarns were made at different spinning (wind-up) speeds. These yarns are referred to as examples A through D in Table V.A.

In another series of experiments the heated tube was shortened by taking out some of its removable sections. Examples E and F in Table V.A. were spun through 7 and 5 meter columns. Other polymers with different molecular weights (I.V.'s) were also spun on this system to give Examples G and H. Example I in Table VA illustrates a case in which lower temperatures were used. In this case a linear gradient from 125° C. to 50° C. was established down the column.

All spun yarns in the series A through I were drawn in a single stage process using an ambient feed roll and a 245° C. draw roll.

In a further series of tests of the sample spun yarn which was described in Example A was drawn using different feed roll temperatures. The results from testing these yarns are given in Examples A, J and K in Table V. B.

TABLE V. A.

| | Spinning Conds | | | | Spun Yarn | | | Drawn Yarn | | |
|---|---|---|---|---|---|---|---|---|---|---|
| Example | Length | Spin Speed mpm | Spin Temp ° C. | Spun IV | Bir | Cryst % | Draw Ratio | Ten gpd | I.M. gpd/100% | HAS %-350° F. |
| A | 9 | 3200 | 155 | 0.84 | .104 | 30.5 | 1.89 | 9.52 | 158 | 7.5 |
| B | 9 | 3500 | 155 | 0.84 | .115 | 34.4 | 1.79 | 9.03 | 150 | 6.8 |
| C | 9 | 3800 | 155 | 0.84 | .121 | 35.9 | 1.74 | 9.08 | 152 | 7.5 |
| D | 9 | 4100 | 155 | 0.84 | .119 | 38.9 | 1.72 | 9.32 | 154 | 6.0 |
| E | 7 | 3200 | 155 | 0.84 | .101 | 30.1 | 1.79 | 8.99 | 142 | 7.3 |
| F | 5 | 3200 | 155 | 0.84 | .073 | 25.0 | 1.98 | 9.52 | 159 | 7.0 |
| G | 9 | 3200 | 155 | 0.76 | .110 | 34.0 | 1.65 | 8.63 | 123 | 6.0 |
| H | 9 | 3200 | 155 | 0.66 | .102 | 22.9 | 1.57 | 7.25 | 110 | 5.0 |
| I | 9 | 4100 | 125 | 0.84 | .120 | 31.9 | 1.53 | 7.34 | 116 | 5.3 |

TABLE V.B.

| Example | Feed Roll Temp ° C. | Draw Ratio | Drawn Tenacity gpd | Drawn I Modulus gpd/100% | Hot Air Shrink %-350° F. |
|---|---|---|---|---|---|
| A | 25 | 1.89 | 9.52 | 158 | 7.5 |
| J | 90 | 1.82 | 10.94 | 173 | 7.7 |
| K | 150 | 1.87 | 10.30 | 158 | 7.4 |

EXAMPLE VI

In the following experimental run, a conventional polymer, nylon, was spun according to the inventive process and compared to nylon made by conventional processes.

The nylon made by the invention process was spun under the following conditions: throughput—37 lbs. per hour; spinning speed—2,362 fpm; denier—3500; number of filaments—68; spun relative viscosity—3.21 ($H_2SO_4$) or 68.4 (HCOOH equiv.) quench air—72 scfm; winding tension 80 g; column length—24 ft; column temperature top 240° C. and bottom 48° C. The as-spun properties of this yarn were as follows: tenacity—0.95 gpd; elongation 235%; $TE^{1/2}$—14.6. Thereafter the yarn was drawn under the following conditions: draw ratio 3.03; draw temperature 90° C. The drawn yarn properties are as follows: tenacity 6.2 gpd; elongation—70%; $TE^{1/2}$—52; 10% modulus—0.87 gpd; hot air shrinkage (HAS) at 400° F.—1.4%.

One comparative nylon was spun in the following conventional fashion: throughput—23.4 lbs. per hour; spinning speed—843 fpm; denier—5556; number of filaments—180; spun relative viscosity—3.3 ($H_2SO_4$) or 72.1 (HCOOH equiv.); quench—150 scfm. Thereafter, the yarn was drawn under the following conditions: Draw ratio—2.01; draw temperature—90° C. The drawn yarn properties are as follows: tenacity 3.8 gpd; elongation—89%; $TE^{1/2}$—33; 10% modulus—0.55 gpd.

Another comparative yarn was spun in the following conventional fashion: throughput—57.5 lbs. per hour; spinning speed—1048 fpm; denier—12400; number of filaments—240; spun relative viscosity—42 (HCOOH equiv.); quench air—150 scfm. Thereafter, the yarn was drawn under the following conditions: draw ratio—3.60; draw temperature—110° C. The drawn yarn properties are as follows: tenacity—3.6 gpd; elongation—70%; $TE^{1/2}$30.1; modulus at 10%—0.8 gpd; HAS (at 400° F.)—2.0%.

EXAMPLE VII

In the following experimental runs, low I.V. (e.g. 0.63) and high I.V. (e.g. 0.92) conventional polyester (i.e. PET) as spun yarn is compared with as spun yarn set forth in U.S. Pat. No. 4,134,882. Examples 1–8 are low I.V. polyester (PET) and are made in the manner set forth in Example I. Examples 9–11 are high I.V. polyester (PET) and are made in the manner set forth in Example V. Examples 12–17 correspond to Examples 1, 5, 12, 17, 36 and 20 of U.S. Pat. No. 4,134,882.

For each example, the spinning speed (fpm), density s/cc), crystal size (Å, 010), long period spacing (LPS), birefringence (biref.), crystal birefringence and amorphous birefringence are given. The results are set forth in Table VII.

TABLE VII

| No. | Spin Speed (fpm) | Density gms/cc | CS 010 Å | LPS Å | Biref. | Crystal Biref. | Amorphous Biref. |
|---|---|---|---|---|---|---|---|
| 1 | 12500 | 1.3728 | 45 | 147 | 0.1080 | 0.1982 | 0.067 |
| 2 | 13500 | 1.3742 | 45 | 160 | 0.1060 | 0.1994 | 0.061 |
| 3 | 14500 | 1.3766 | 47 | 155 | 0.1150 | 0.2004 | 0.070 |
| 4 | 15500 | 1.3788 | 50 | 158 | 0.1120 | 0.2021 | 0.060 |
| 5 | 16500 | 1.3804 | 51 | 145 | 0.1180 | 0.2035 | 0.066 |
| 6 | 17500 | 1.3827 | 53 | 152 | 0.1240 | 0.2042 | 0.071 |
| 7 | 18500 | 1.3840 | 55 | 147 | 0.1270 | 0.2055 | 0.073 |
| 8 | 19000 | 1.3841 | 54 | 150 | 0.1300 | 0.2052 | 0.078 |
| 9 | 10000 | 1.3485 | 21 | 192 | 0.0761 | 0.1824 | 0.063 |
| 10 | 10000 | 1.3653 | 43 | 192 | 0.1047 | 0.1930 | 0.075 |
| 11 | 12500 | 1.3749 | 52 | 183 | 0.1215 | 0.1994 | 0.083 |
| 12 | 16500 | 1.3700 | 61 | 313 | 0.0958 | 0.2010 | 0.045 |
| 13 | 18000 | 1.3770 | 73 | 329 | 0.1082 | 0.2010 | 0.057 |
| 14 | 19500 | 1.3887 | 72 | 325 | 0.1153 | 0.2030 | 0.054 |
| 15 | 21000 | 1.3868 | 68 | 330 | 0.1241 | 0.2050 | 0.063 |
| 16 | 21000 | 1.3835 | 64 | | 0.1236 | 0.1980 | 0.073 |
| 17 | 16500 | 1.3766 | 65 | | 0.0965 | 0.2060 | 0.038 |

The present invention may be embodied in other specific forms without departing from the spirit or essential attributes thereof and, accordingly, reference should be made to the appended claims, rather than to the foregoing specification, as indicating the scope of the invention.

We claim:

1. A drawn yarn being characterized by:

an initial secant modulus greater than 150 grams per denier/100%, the initial secant modulus being determined by passing a line through 0.5% and 1.0% elongation points on the yarn's stress-strain curve;

a polyester polymer having at least 85% of an ester of terephthalic acid and ethylene glycol; and an intrinsic viscosity of the starting polyester polymer being less than 1.0.

2. The yarn according to claim 1 being further characterized by a shrinkage of less than 8%.

3. The yarn according to claim 1 being further characterized by a tenacity greater than 9.0 grams per denier.

4. The yarn according to claim 1 being further characterized by a shrinkage of less than 7.5%.

5. The yarn according to claim 1 comprising a plurality of fiber having a denier per filament ranging from about 1.5 to about 6.0.

6. The yarn according to claim 1 wherein the intrinsic viscosity of the starting polyester polymer being between 0.6 and 0.9.

* * * * *